US011932957B2

(12) United States Patent
Kondoh

(10) Patent No.: US 11,932,957 B2
(45) Date of Patent: Mar. 19, 2024

(54) METHOD FOR FORMING METAL FILM

(71) Applicant: TOYOTA JIDOSHA KABUSHIKI KAISHA, Toyota (JP)

(72) Inventor: Haruki Kondoh, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 12 days.

(21) Appl. No.: 17/807,935

(22) Filed: Jun. 21, 2022

(65) Prior Publication Data

US 2022/0403544 A1 Dec. 22, 2022

(30) Foreign Application Priority Data

Jun. 22, 2021 (JP) ..... 2021-103471

(51) Int. Cl.
*C25D 21/10* (2006.01)
*C25D 17/06* (2006.01)
*C25D 17/10* (2006.01)

(52) U.S. Cl.
CPC ..... *C25D 21/10* (2013.01); *C25D 17/06* (2013.01); *C25D 17/10* (2013.01)

(58) Field of Classification Search
None
See application file for complete search history.

(56) References Cited

U.S. PATENT DOCUMENTS 7,553,400 B2 * 6/2009 Nagai ..... C25D 5/611 205/137
8,029,653 B2 * 10/2011 Yamamoto ..... C25D 17/001 204/272
2002/0151257 A1 * 10/2002 Basol ..... B24B 37/30 451/388
2016/0076162 A1 3/2016 Sato et al.
2016/0186353 A1 * 6/2016 Sato ..... C25D 3/00 205/261
2017/0335479 A1 * 11/2017 Sato ..... C25D 5/06
2018/0237933 A1 * 8/2018 Mayer ..... C25D 21/18
2020/0299855 A1 * 9/2020 Sato ..... C25D 7/0642

FOREIGN PATENT DOCUMENTS

JP 2014185371 A 10/2014
JP 2022012256 A 1/2022

* cited by examiner

*Primary Examiner* — Stefanie S Wittenberg
(74) *Attorney, Agent, or Firm* — Dickinson Wright, PLLC

(57) ABSTRACT

Provided is a method for forming a metal film using a solid-state electrolyte membrane, and the method allows a metal film having a smooth surface to be formed and an additive to sufficiently serve its function. A method for forming a metal film includes the successive steps of (a) supplying a solution to a solution-housing space, the solution containing ions of the metal and an additive; (b) increasing a pressure of the solution in the solution-housing space in a state where the solution-housing space is uncommunicated with a solution tank and the substrate held by a holder is in contact with the solid-state electrolyte membrane; (c) decreasing the pressure of the solution in the solution-housing space; and (d) forming the film of the metal on the substrate by applying a voltage between an anode and the substrate while the solution is circulated between the solution-housing space and the solution tank.

4 Claims, 9 Drawing Sheets

METHOD FOR FORMING METAL FILM

CROSS REFERENCE TO RELATED APPLICATIONS

The present application claims priority from Japanese patent application JP 2021-103471 filed on Jun. 22, 2021, the entire content of which is hereby incorporated by reference into this application.

BACKGROUND

Technical Field

The present disclosure relates to a method for forming a metal film.

Background Art

There has been a plating method as one of the methods for forming a metal film on a surface of a substrate. The plating method has been widely used in the manufacture of various products, such as a wiring board. However, there has been a problem that water cleaning of the substrate is necessary after forming the metal film by the plating method, thus generating a large amount of waste liquid. Therefore, J P 2014-185371 A proposes a method for forming a metal film as an alternative to the conventional plating method. In the method disclosed in JP 2014-185371 A, a solid electrolyte membrane is disposed between an anode and a cathode (substrate), a solution containing metal ions is disposed between the anode and the solid electrolyte membrane, the solid electrolyte membrane is brought in contact with the substrate, and a voltage is applied between the anode and the substrate, thus causing the metal to be deposited on a surface of the substrate.

SUMMARY

In the method disclosed in JP 2014-185371 A, a metal film grows while being in contact with the solid electrolyte membrane. When the solid electrolyte membrane has a crease or air bubbles are present between the solid electrolyte membrane and the metal film, a metal film with a low surface smoothness is formed in some cases.

In the conventional plating method, various kinds of additives for controlling a surface profile, an appearance, a physical property, and the like of a metal film are generally added to a plating solution. In the method using a solid electrolyte membrane as disclosed in JP 2014-185371 A, it is desired to allow using an additive for improving the quality of a metal film as well.

Therefore, the present disclosure provides a method for forming a metal film using a solid-state electrolyte membrane (solid electrolyte membrane) which allows a metal film having a smooth surface to be formed and an additive to sufficiently serve its function.

One aspect of the present disclosure is a method for forming a film of a metal on a substrate using a film forming apparatus. In the method, the film forming apparatus includes an anode, a holder holding the substrate, a solid-state electrolyte membrane disposed between the anode and the holder, a housing defining a solution-housing space between the anode and the solid-state electrolyte membrane, and a solution tank communicatable with the solution-housing space. The method comprises the successive steps of: (a) supplying a solution to the solution-housing space, the solution containing ions of a metal and an additive; (b) increasing a pressure of the solution in the solution-housing space in a state where the solution-housing space is uncommunicated with the solution tank and the substrate held by the holder is in contact with the solid-state electrolyte membrane; (c) decreasing the pressure of the solution in the solution-housing space; and (d) forming the film of the metal on the substrate by applying a voltage between the anode and the substrate while the solution is circulated between the solution-housing space and the solution tank.

With the method of the present disclosure, the metal film having the smooth surface can be formed, and the additive can sufficiently serve its function.

DETAILED DESCRIPTION

Figure 1:
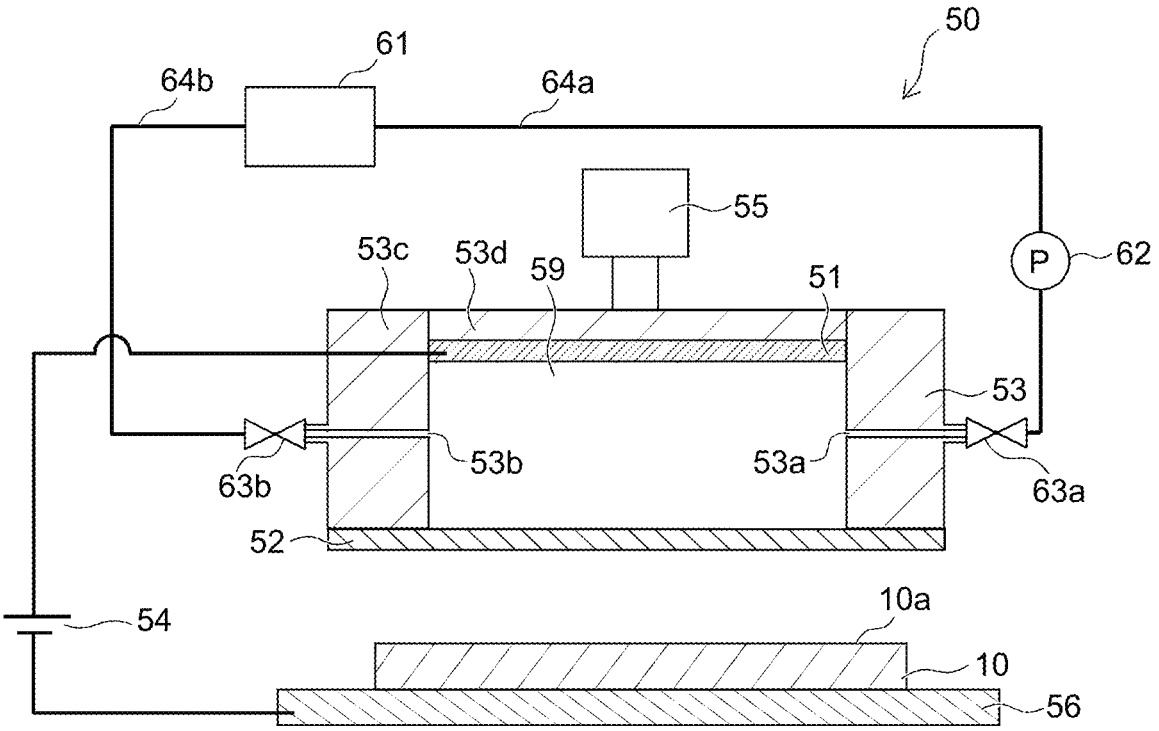
FIG. 1 is a schematic cross-sectional view illustrating an exemplary film forming apparatus used for a method according to the embodiment.

The following describes embodiments with reference to the drawings as necessary. In the drawings referred in the following description, the same reference numerals may be attached to the same members or the members having similar functions, and their repeated explanations may be omitted in some cases. For convenience of explanation, a dimensional ratio in the drawing may be different from the actual ratio, and a part of a member may be omitted in the drawing in some cases. In this application, a numerical range expressed using the term "to" includes respective values described before and after the term "to" as the lower limit value and the upper limit value. The present disclosure is not limited to the embodiments below, and can be subjected to various kinds of changes in design without departing from the spirit or scope of the present disclosure described in the claims.

(1) Film Forming Apparatus

An exemplary film forming apparatus used for a method according to the embodiment will be described. A film forming apparatus 50 illustrated in FIG. 1 includes an anode 51, a holder 56, a solid-state electrolyte membrane 52, a housing 53, and a solution tank 61.

The anode 51 has a sufficient conductivity to function as an electrode. The anode 51 contains at least one of a metal to be formed into a film by the film forming apparatus 50 or a metal (for example, gold) having a standard oxidation-reduction potential (standard electrode potential) higher than a standard oxidation-reduction potential of the metal to be formed into a film by the film forming apparatus 50. A shape and dimensions of the anode 51 may be appropriately set, and for example, the anode 51 may have a foil shape, a plate shape, a ball shape, or the like.

The holder 56 holds a substrate 10 such that a surface 10*a* of the substrate 10 on which a metal film is to be formed is opposed to the anode 51. The holder 56 may be, for example, a pedestal on which the substrate 10 is placeable.

At least a part of the surface 10*a* of the substrate 10 has a sufficient conductivity to function as an electrode. The substrate 10 may be, for example, a substrate formed of a conductive material, or an insulating substrate with a conductive material film formed on at least a part of a surface of the insulating substrate. Examples of the conductive material include Pt, Pd, Rh, Cu, Ag, Au, Ti, Al, Cr, Si, and an alloy of them, silicide such as $FeSi_2$, $CoSi_2$, $MoSi_2$, $WSi_2$, $VSi_2$, $ReSi_{1.75}$, $CrSi_2$, $NbSi_2$, $TaSi_2$, $TiSi_2$, and $ZrSi_2$, especially, transition metal silicide, a conductive metal oxide such as $TiO_2$, SnO, GeO, and ITO (indium tin oxide), and a conductive resin. Examples of the insulating substrate include a resin substrate, a glass substrate, and a substrate containing a resin and a glass, such as a glass epoxy resin substrate. Examples of the resin include a thermoplastic resin such as PET resin, PI resin, LCP (liquid crystal polymer), epoxy resin, ABS resin, AS resin, AAS resin, PS resin, EVA resin, PMMA resin, PBT resin, PPS resin, PA resin, POM resin, PC resin, PP resin, PE resin, polymer alloy resin containing elastomer and PP, modified PPO resin, PTFE resin, and ETFE resin, a thermosetting resin such as phenol resin, melamine resin, amino resin, unsaturated polyester resin, polyurethane, diallyl phthalate, silicone resin, and alkyd resin, and a resin in which a cyanate resin is added to an epoxy resin.

The surface 10*a* of the substrate 10 is electrically connected to a power supply unit 54 described later. In FIG. 1, the surface 10*a* of the substrate 10 is electrically connected to the power supply unit 54 via the holder 56. The film forming apparatus 50 may further include a conductive member (not illustrated) that covers at least a part of an edge portion of the surface 10*a* of the substrate 10, and the surface 10*a* of the substrate 10 may be electrically connected to the power supply unit 54 via the conductive member.

The solid-state electrolyte membrane 52 is disposed between the anode 51 and the holder 56. As the solid-state electrolyte membrane 52, for example, a membrane of a resin having a cation-exchange function, such as a fluorine-based resin (e.g., Nafion (registered trademark) manufactured by DuPont), a hydrocarbon resin, a polyamic acid resin, or Selemion (CMV, CMD, CMF series) manufactured by AGC Inc., may be used. The solid-state electrolyte membrane 52 may have a thickness of, for example, from about 5 μm to about 200 μm.

The housing 53 defines a solution-housing space 59 between the anode 51 and the solid-state electrolyte membrane 52. The housing 53 includes a cylindrical or polygonal cylindrical body 53*c* having openings at the top and the bottom, and a lid portion 53*d* covering the opening at the top of the body 53*c*. The opening at the bottom of the body 53*c* is covered with the solid-state electrolyte membrane 52. The anode 51 is disposed between the solid-state electrolyte membrane 52 and the lid portion 53*d* while being separated from the solid-state electrolyte membrane 52. The solution-housing space 59 is defined between the anode 51 and the solid-state electrolyte membrane 52. The solution-housing space 59 houses a solution containing ions of a metal. While the anode 51 is disposed to be in contact with the lid portion 53*d* in FIG. 1, the anode 51 may be separated from the lid portion 53*d*. In this case, the solution may be housed also between the anode 51 and the lid portion 53*d*. The housing 53 is provided with a supply port 53*a* and a discharge port 53*b*.

The solution tank 61 is connected to the supply port 53*a* and the discharge port 53*b* of the housing 53 via a supply pipe 64*a* and a discharge pipe 64*b*, respectively. Valves 63*a*, 63*b* are disposed at a connecting portion of the supply pipe 64*a* and the supply port 53*a* and a connecting portion of the discharge pipe 64*b* and the discharge port 53*b*, respectively. By opening and closing the valves 63*a*, 63*b*, the solution-housing space 59 can be communicated with the solution tank 61 and separated from the solution tank 61. A pump 62 is connected to the supply pipe 64*a* or the discharge pipe 64*b*.

The film forming apparatus 50 may further include an elevating device (not illustrated) that moves the holder 56 or the housing 53 up and down to bring the solid-state electrolyte membrane 52 in contact with the surface 10*a* of the substrate 10 held by the holder 56. The elevating device may include a hydraulic or pneumatic cylinder, an electrically operated actuator, a linear guide, a motor, and the like.

The film forming apparatus 50 may further include a pressurizing mechanism 55 to increase a pressure of the solution in the solution-housing space 59. The pressurizing mechanism 55 may be, for example, a device to press the lid portion 53*d* toward the inside of the housing 53, and may include a hydraulic or pneumatic cylinder, an electrically operated actuator, a linear guide, a motor, and the like.

The film forming apparatus 50 further includes the power supply unit 54. The power supply unit 54 has a negative electrode electrically connected to the surface 10*a* of the substrate 10 via the holder 56, and the power supply unit 54 has a positive electrode electrically connected to the anode 51.

(2) Method for Forming Metal Film

Figure 2:
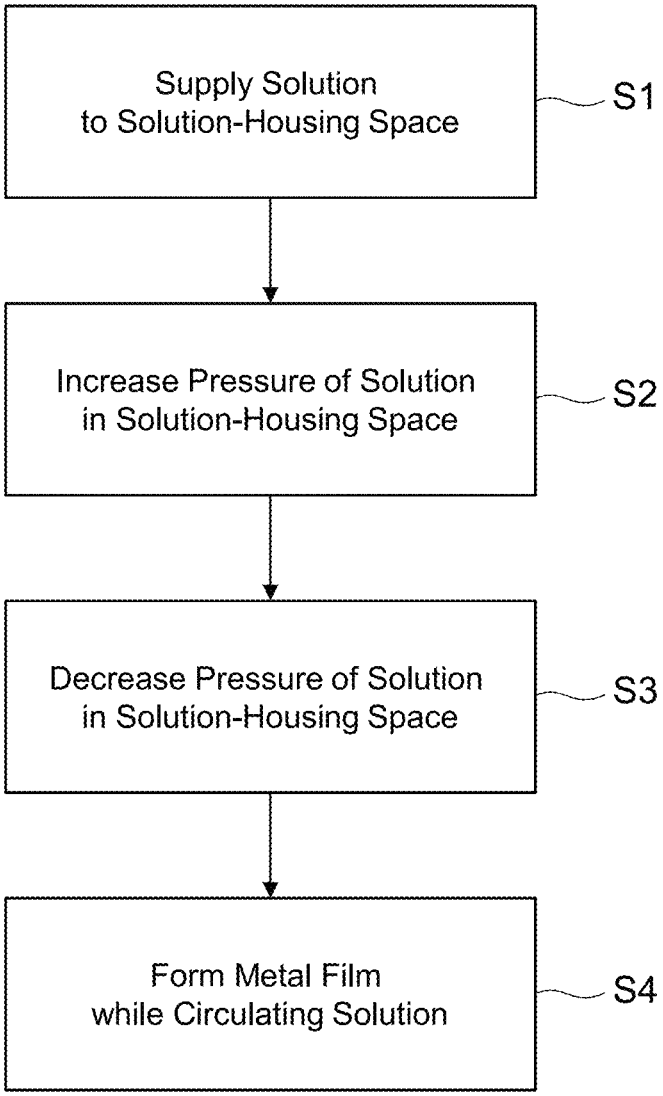
FIG. 2 is a flowchart illustrating the method according to the embodiment.

As illustrated in FIG. 2, the method according to the embodiment includes, in the sequence set forth: a step (S1) of supplying a solution to a solution-housing space, a step (S2) of increasing a pressure of the solution in the solution-housing space, a step (S3) of decreasing the pressure of the solution in the solution-housing space, and a step (S4) of forming a metal film while circulating the solution.

a) Step (S1) of Supplying Solution to Solution-Housing Space

First, a solution containing metal ions and an additive is prepared and put into the solution tank 61.

Examples of the metal ion include ions of Cu, Ni, Ag, and Au. The solution may further contain at least one of nitrate ion, phosphate ion, succinate ion, sulfate ion, or pyrophosphate ion. The solution may be a solution of a metal salt, such as nitrate, phosphate, succinate, hydrosulfate, and pyrophosphate, or a mixture of them.

The additive may be at least one additive selected from the group consisting of a polymer, a brightener, and a leveler. The additive may be similar to an additive used in an ordinary electrolytic plating, and may be appropriately selected depending on a material of a metal film formed by the method according to the embodiment.

As the polymer, for example, a nonionic polyether polymer surfactant, such as polyethylene glycol, polypropylene glycol, polyethylene oxide, and polyoxyalkylene glycol, can be used. The polymer has an action of improving a uniformity of a thickness of a metal film to be formed by forming a monomolecular film on the surface 10*a* of the substrate 10 to suppress deposition of the metal.

As the brightener, for example, a sulfur-containing organic compound, more specifically, an organic sulfur based compound having a sulfone group, such as 3-mercaptopropane sulfonic acid, its sodium salt, bis(3-sulfopropyl) disulfide, its disodium salt, N,N-dimethyldithiocarbamic acid(3-sulfopropyl) ester, and its sodium salt, can be used. The brightener has an action of providing a gloss to a metal film to be formed by accelerating the metal deposition and miniaturizing particles of the deposited metal.

As the leveler, for example, a quaternary ammonium compound such as Janus Green B (JGB) or a safranine compound, and a nitrogen-containing organic compound such as a phenazine compound, polyalkyleneimine, thiourea or its derivative, or polyacrylic acid amide can be used. The leveler has an action of improving a flatness of a metal film to be formed by adsorbing to protruding portions at which the metal is easily deposited and suppressing the metal deposition at the protruding portions.

Figure 3:
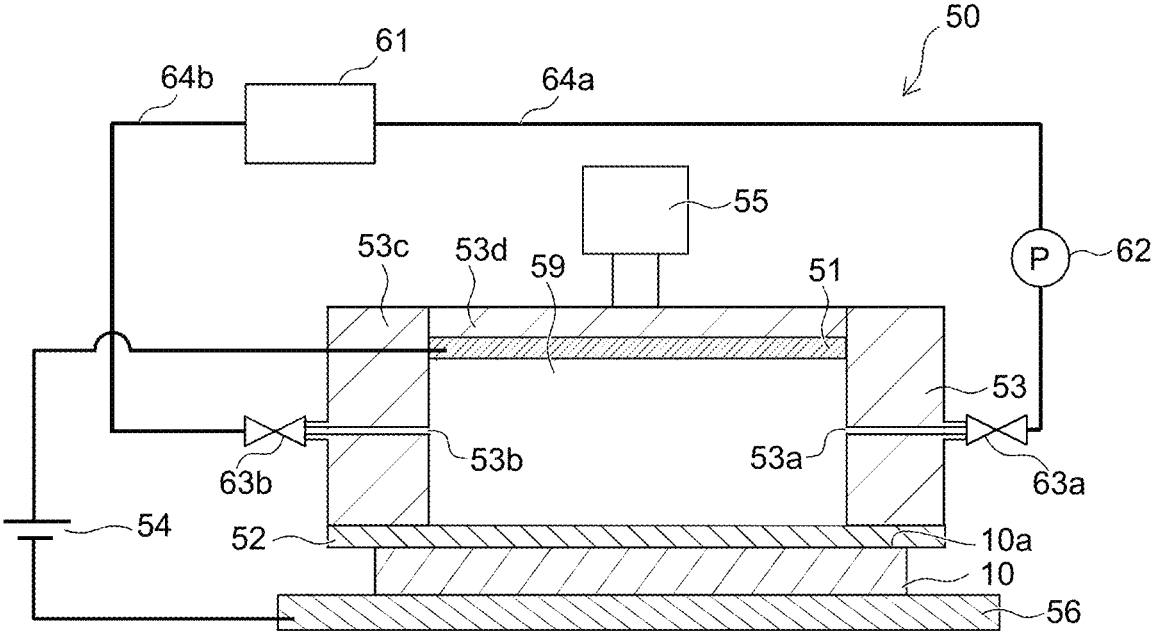
FIG. 3 is a schematic cross-sectional view illustrating the exemplary film forming apparatus in which a substrate is brought in contact with a solid-state electrolyte membrane.

As illustrated in FIG. 1, the holder 56 of the film forming apparatus 50 holds the substrate 10. Next, as illustrated in FIG. 3, the holder 56 is moved up and/or the housing 53 is moved down, thereby bringing the solid-state electrolyte membrane 52 in contact with the surface 10*a* of the substrate 10.

Figure 4:
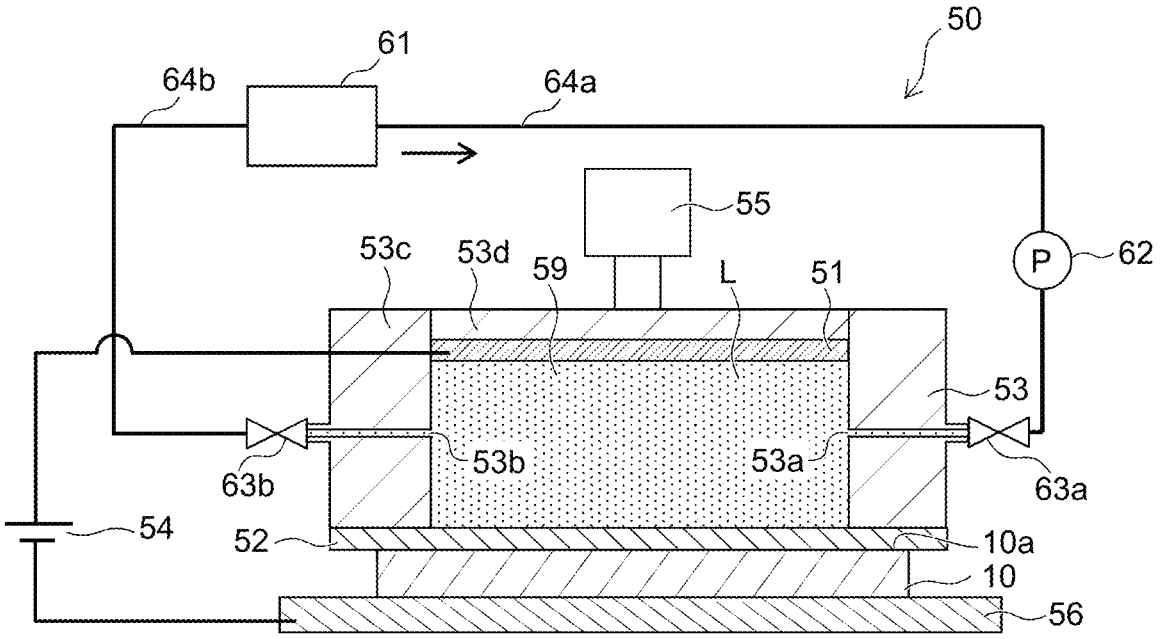
FIG. 4 is a schematic cross-sectional view illustrating the exemplary film forming apparatus in a step of supplying a solution to a solution-housing space.

Next, as illustrated in FIG. 4, a solution L is supplied from the solution tank 61 to the solution-housing space 59. By operating the pump 62, the solution L is sent out from the solution tank 61 to the supply pipe 64*a*, and flows into the solution-housing space 59 passing through the supply port 53*a*. The solution L contacts the solid-state electrolyte membrane 52 and penetrates through the solid-state electrolyte membrane 52. Consequently, the solid-state electrolyte membrane 52 internally includes the solution L.

b) Step (S2) of Increasing Pressure of Solution in Solution-Housing Space

Figure 5:
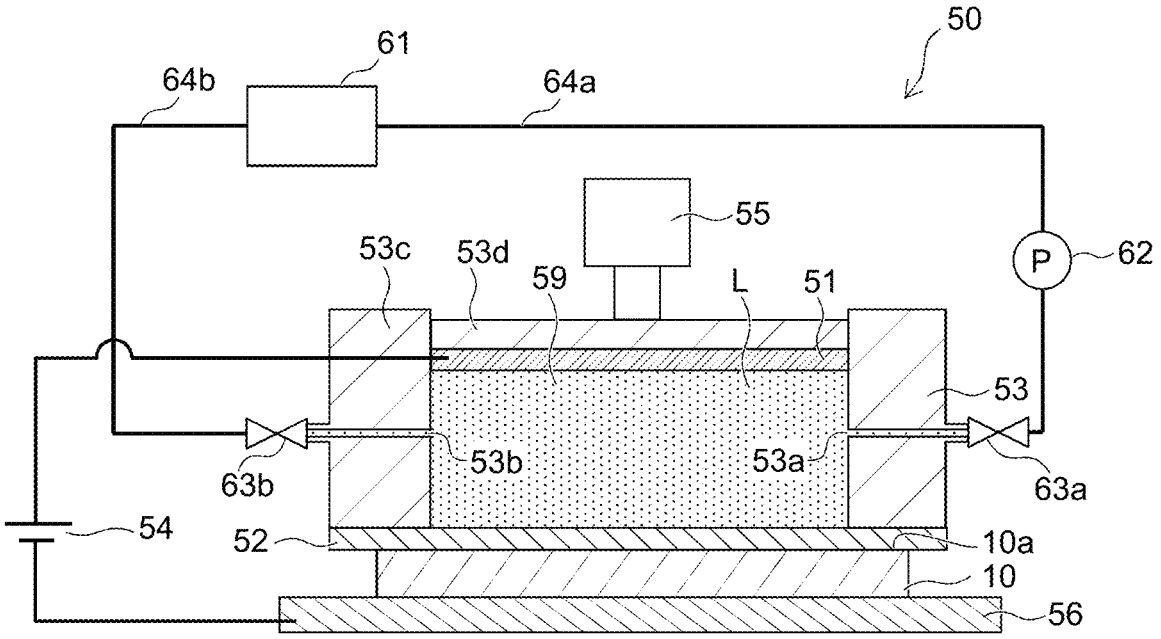
FIG. 5 is a schematic cross-sectional view illustrating the exemplary film forming apparatus in a step of increasing a pressure of the solution in the solution-housing space.

After stopping the pump 62, the valves 63*a*, 63*b* are closed to separate the solution-housing space 59 from the solution tank 61. That is, the solution-housing space 59 becomes uncommunicated with the solution tank 61. Next, a pressure of the solution L in the solution-housing space 59 is increased. For example, the pressure of the solution L in the solution-housing space 59 can be increased by applying an external force to the solution L in the solution-housing space 59. Specifically, as illustrated in FIG. 5, the lid portion 53*d* may be pressed toward the inside of the housing 53 by the pressurizing mechanism 55 to apply an external force to the solution L, thereby allowing increasing the pressure of the solution L. When the solid-state electrolyte membrane 52 has a crease or air bubbles are present between the solid-state electrolyte membrane 52 and the substrate 10, increasing the pressure of the solution L allows smoothing the crease and removing the air bubbles. Since the valves 63*a*, 63*b* are closed, the pressure of the solution L in the solution-housing space 59 can be increased to a pressure exceeding allowable pressures of the solution tank 61, the members (the supply pipe 64*a*, the discharge pipe 64*b*, the pump 62, and the like) between the solution tank 61 and the valves 63*a*, 63*b*, and the connecting portions of them. The pressure of the solution L may be appropriately set in a range in which the crease and/or the air bubbles can be sufficiently removed and the solid-state electrolyte membrane 52 remains unbroken, and may be, for example, from 0.2 MPa to 1 MPa.

c) Step (S3) of Decreasing Pressure of Solution in Solution-Housing Space

Next, the pressure of the solution L in the solution-housing space 59 is decreased. For example, the pressure of the solution L in the solution-housing space 59 can be decreased by decreasing the external force applied to the solution L in the solution-housing space 59 (especially, decreasing to zero). Specifically, the pressure of the solution L can be decreased by lowering the force of the pressurizing mechanism 55 pressing the lid portion 53*d* or stopping pressing the lid portion 53*d*.

d) Step (S4) of Forming Metal Film while Circulating Solution

The valves 63*a*, 63*b* are opened to cause the solution-housing space 59 to be communicated with the solution tank 61. Next, the pump 62 is operated to circulate the solution L between the solution-housing space 59 and the solution tank 61 via the supply pipe 64*a* and the discharge pipe 64*b*. While the solution L continues to be circulated, a voltage is applied between the anode 51 and the surface 10*a* of the substrate 10 by the power supply unit 54. Thus, the metal ions contained in the solution L are reduced on the surface 10*a* of the substrate 10, and the metal is deposited on the surface 10*a* of the substrate 10. Furthermore, the metal ions are reduced also on a surface of the deposited metal, and the metal is further deposited. Accordingly, a metal film is formed on the surface 10*a* of the substrate 10. The voltage applied between the anode 51 and the surface 10*a* of the substrate 10 may be appropriately set. Applying a higher voltage allows increasing a deposition rate of the metal. The solution L may be heated. Thus, the deposition rate of the metal can be increased.

Since the crease of the solid-state electrolyte membrane 52 and/or the air bubbles between the solid-state electrolyte membrane 52 and the surface 10*a* of the substrate 10 are removed in Step S2, it is avoided or reduced that the crease and/or the air bubbles adversely affect the smoothness of the surface of the metal film in Step S4. Therefore, the metal film with smooth surface can be formed. Since the metal film is formed while the solution L continues to be circulated, depletion of the additive in the solution-housing space 59 is avoided. Therefore, the additive is supplied to the position of the metal deposition and its proximity by a sufficient amount, thus sufficiently serving its function. For example, when the solution L contains a polymer as an additive, a metal film having a uniform thickness can be formed. When the solution L contains a brightener as an additive, a metal film with metallic luster can be formed. When the solution L contains a leveler as an additive, a metal film having a high flatness can be formed.

After the metal film having a desired thickness is formed, the voltage application between the anode 51 and the substrate 10 is stopped, and the pump 62 is stopped to stop the circulation of the solution L. The holder 56 is moved down and/or the housing 53 is moved up, thus separating the solid-state electrolyte membrane 52 from the metal film (not illustrated). The substrate 10 on which the metal film has been formed is removed from the holder 56.

EXAMPLES

While the following specifically describes the present disclosure with examples, the present disclosure is not limited to the examples.

Example 1

The film forming apparatus 50 as illustrated in FIG. 1 was prepared. A mesh-like titanium container and a copper ball housed therein were used as the anode 51. As the solid-state electrolyte membrane 52, Nafion (registered trademark) (thickness about 8 μm) was used. A FR-4 copper clad laminate was prepared as the substrate 10, and held by the holder 56. A solution ("Cu BRITE SED" manufactured by JCU) containing a copper ion and an additive was put into the solution tank 61 and heated to 42° C. Next, as illustrated in FIG. 3, the solid-state electrolyte membrane 52 was brought in contact with the substrate 10.

The valves 63*a*, 63*b* were opened, and the pump 62 was operated, thereby supplying the solution L from the solution tank 61 to the solution-housing space 59 with a flow rate of 1 L/minute as illustrated in FIG. 4 (Step S1).

The pump 62 was stopped and the valves 63*a*, 63*b* were closed. Next, as illustrated in FIG. 5, the lid portion 53*d* was pressed by the pressurizing mechanism 55 to increase the pressure of the solution L in the solution-housing space 59 to 0.6 MPa (Step S2).

Pressing the lid portion 53*d* by the pressurizing mechanism 55 was stopped, thus decreasing the pressure of the solution L in the solution-housing space 59 (Step S3). The pressure of the solution L in the solution-housing space 59 was approximately the same as the atmospheric pressure.

Figure 6:
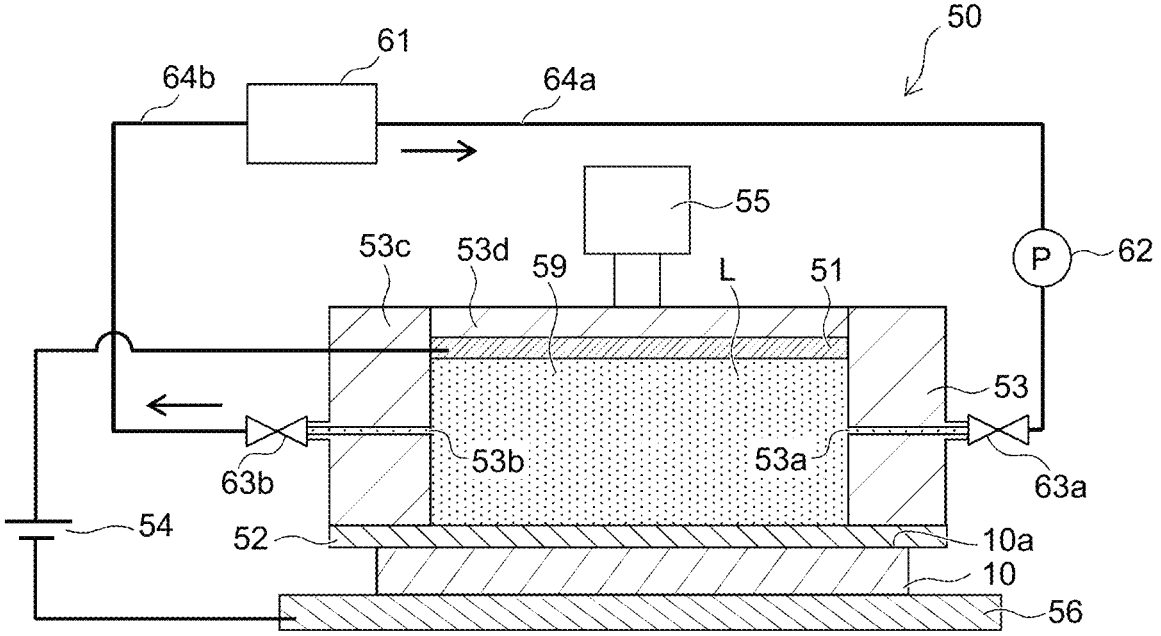
FIG. 6 is a schematic cross-sectional view illustrating the exemplary film forming apparatus in a step of forming a metal film.
Figure 7:
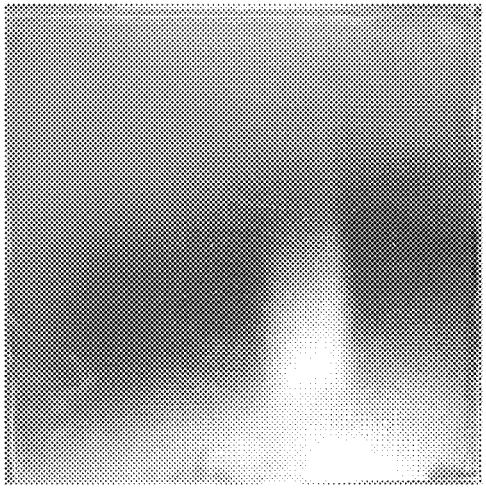
FIG. 7 is a photograph of a copper film of Example 1.

The valves 63*a*, 63*b* were opened, and the pump 62 was operated, thus circulating the solution L between the solution tank 61 and the solution-housing space 59 with the flow rate of 1 L/minute as illustrated in FIG. 6. A voltage was applied between the anode 51 and the substrate 10 to cause a current to flow with a current density of 6.8 A/dm$^2$. Thus, copper was deposited on the surface 10*a* of the substrate 10, and a copper film was formed (Step S4). FIG. 7 is a photograph of the formed copper film. The copper film had a smooth surface with a uniform metallic luster.

Comparative Example 1

Figure 8:
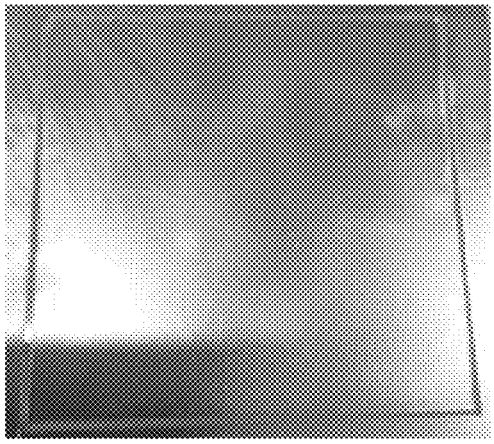
FIG. 8 is a photograph of a copper film of Comparative Example 1.

Step S1 was performed similarly to Example 1. While the solution L was circulated between the solution tank 61 and the solution-housing space 59 with the flow rate of 1 L/minute, a voltage was applied between the anode 51 and the substrate 10 similarly to Step S4 of Example 1 to form a copper film on the surface 10*a* of the substrate 10. FIG. 8 is a photograph of the formed copper film. The copper film had a partially uneven surface (see upper left portion of FIG. 8). In this comparative example, it is considered that since the pressure of the solution L in the solution-housing space 59 was not increased before forming the copper film, the crease of the solid-state electrolyte membrane 52 remained without being smoothed, and the crease was transferred to the copper film.

Comparative Example 2

Figure 9:
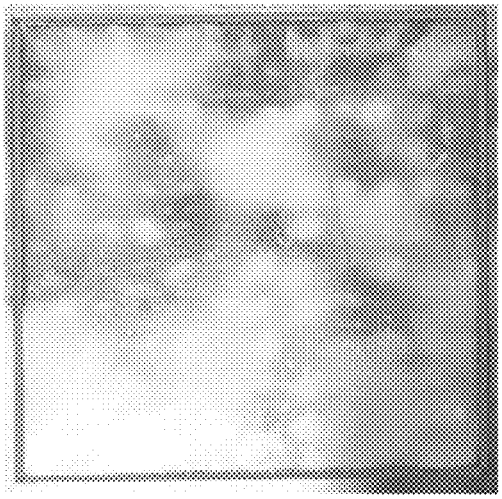
FIG. 9 is a photograph of a copper film of Comparative Example 2.

Step S1 and Step S2 were performed similarly to Example 1. While pressing the lid portion 53*d* by the pressurizing mechanism 55 was continued, a voltage was applied between the anode 51 and the substrate 10 to form a copper film on the surface 10*a* of the substrate 10. FIG. 9 is a photograph of the formed copper film. The metallic luster of the surface of the copper film was not uniform. In this comparative example, since the valves 63*a*, 63*b* were closed to increase the pressure of the solution L during forming the copper film, the solution L was not circulated. Therefore, it is considered that since the supply of the additive to the position of the copper deposition and its proximity was insufficient and the additive could not sufficiently serve its function, the metallic luster of the copper film was not uniform.

What is claimed is:

1. A method for forming a film of a metal on a substrate using a film forming apparatus, the film forming apparatus including:

an anode;

a holder holding the substrate;

a solid-state electrolyte membrane disposed between the anode and the holder;

a housing defining a solution-housing space between the anode and the solid-state electrolyte membrane; and a solution tank communicatable with the solution-housing space, the method comprising the successive steps of:

(a) supplying a solution to the solution-housing space, the solution containing ions of the metal and an additive;

(b) increasing a pressure of the solution in the solution-housing space in a state where the solution-housing space is uncommunicated with the solution tank and the substrate held by the holder is in contact with the solid-state electrolyte membrane;

(c) decreasing the pressure of the solution in the solution-housing space; and (d) forming the film of the metal on the substrate by applying a voltage between the anode and the substrate while the solution is circulated between the solution-housing space and the solution tank.

2. The method according to claim 1, wherein the step (a) includes supplying the solution to the solution-housing space in a state where the substrate held by the holder is in contact with the solid-state electrolyte membrane.

3. The method according to claim 1, wherein the additive is at least one selected from the group consisting of a polymer, a brightener, and a leveler.

4. The method according to claim 1, wherein the step (b) includes applying an external force to the solution to increase the pressure of the solution in the solution-housing space, and wherein the step (c) includes stopping applying the external force.

* * * * *